US011686185B2

(12) United States Patent
Salihbegovic

(10) Patent No.: US 11,686,185 B2
(45) Date of Patent: Jun. 27, 2023

(54) HIGH PRESSURE GAS LIFT VALVE WITH DUAL EDGE WELDED BELLOWS

(71) Applicant: Zlatko Salihbegovic, New Iberia, LA (US)

(72) Inventor: Zlatko Salihbegovic, New Iberia, LA (US)

( * ) Notice: Subject to any disclaimer, the term of this patent is extended or adjusted under 35 U.S.C. 154(b) by 228 days.

(21) Appl. No.: 17/072,846

(22) Filed: Oct. 16, 2020

(65) Prior Publication Data

US 2021/0054725 A1 Feb. 25, 2021

(51) Int. Cl.

| | |
|---|---|
| ***E21B 43/12*** | (2006.01) |
| ***E21B 34/10*** | (2006.01) |
| ***E21B 34/08*** | (2006.01) |

(52) U.S. Cl.

CPC ..... *E21B 43/123* (2013.01); *E21B 34/08* (2013.01); *E21B 34/101* (2013.01); *E21B 2200/06* (2020.05)

(58) Field of Classification Search

CPC ..... E21B 2200/06; E21B 34/08; E21B 34/10; E21B 34/101; E21B 43/123

See application file for complete search history.

(56) References Cited

U.S. PATENT DOCUMENTS 8,701,779 B2 * 4/2014 Kleppa ..... E21B 34/08 166/326

2004/0182437 A1 * 9/2004 Messick ..... E21B 43/123 137/155

* cited by examiner

*Primary Examiner* — James G Sayre

(57) ABSTRACT

High pressure gas lift valve with dual edge welded bellow subassembly where two bellows are incorporated in sealed configuration filled with silicone oil. Bellows are of different sizes featuring equal volumetric oil displacement for the pre-set total compression/expansion which corresponds to equal stem travel. By design both bellows can be fully compressed solid preventing bellows overstressing allowing extremely high pressure to be applied to both bellows. Lower bellow effective area is larger for orifice area than upper bellow area. This eliminates differential pressure across the bellows during valve opening resulting in equalized internal/external bellow stresses. Both bellows work only in compression from free length to full compression. This results in bellow internal/external pressure and stress level equalization and long cycle life. Valve withstands high injection pressure for well integrity testing. Once lower bellow is fully compressed solid high pressure would not be transmitted to upper bellow and vice versa.

9 Claims, 7 Drawing Sheets

HIGH PRESSURE GAS LIFT VALVE WITH DUAL EDGE WELDED BELLOWS

BACKGROUND OF THE INVENTION

1. Field of the Invention: Oil and Gas Industry

This invention generally relates to GLV-gas lift valve for artificial lift-production of oil from oil wells, and more particularly, to gas lift valves capable of operating at very high differential pressures.

2. Description of Related Art

Gas lift valves have been used for many years to inject compressed gas into oil and gas wells to assist in the lifting-production of well fluids to the surface. The valves have evolved into devices in which metal bellows, of variety of sizes, convert pressure into movement. This allows the injected compressed gas to act upon the bellows to open the valve and pass through a control mechanism into the fluid fed in from the well's producing zone into the well bore. As differential pressure is reduced on the bellows, the valve can close. Two types of GLV-gas lift valves use bellows. The first uses a non-gas charged, atmospheric bellows and requires spring to close the valve mechanism. The other mechanism uses an internal gas charge, usually Nitrogen, in the bellows and volume dome sub to provide the closing force for the valve. In both configurations, pressure differential on the bellows from the injected high-pressure gas opens the valve mechanism. Bellows are generally a seals that separate dome pressure from injection pressure.

In the case of the non-gas charged bellows, the atmospheric pressurized bellows are subjected to high differential pressure when the valve is installed in a well and exposed to high operating gas injection pressure. The Nitrogen charged bellows are subjected to high internal bellows pressure after dome charging and prior to installation. Once installed, the differential pressure across the bellows is lower than in non-gas charged bellows during operation of the GLV. High differential pressure across a bellows during operation reduces the bellow cycle life. The existing GLV and bellows are not designed to operate with set pressures or in operating pressures in excess of 2000 PSI without severe failure risks. Some existing valve bellows do have some form of fluid/and or mechanical protection from overpressure due to operating pressures in the fully open position. However, none provides protection from differential overpressure from set pressure in the bellows-dome sub when Nitrogen is pressurized and prior to installation into GLM-gas lift mandrel and well. In addition, Nitrogen is permanent gas which means it will not get to liquid state no matter how high the pressure is unless it is cooled which is not happening in GLV. When silicone oil is in direct contact with pressurized Nitrogen, bubbles of Nitrogen would be absorbed into silicone oil rendering it not non-compressible fluid, it is a mixture of fluid and gas bubbles. This means that all these theories for bellow hydraulic protection by non-compressible fluid are simply not accurate. Even if silicone oil is somehow de-gassed there must be separation of oil from pressurized Nitrogen but again, when bellow is exposed to higher pressures than designed for, convolution deformation occur, non-compressible fluid simply does not help: If high differential pressure is applied from outside bellow it would compress/deform outside OD convolutions against inner ID convolutions that will be exposed to expansion and would deform in expansion. These deformations would significantly reduce bellow cycle life. Wide accepted practice in gas lift industry bellow crimping and ageing process where bellows are compressed-shortened in controlled manner by exposing it to approximately 4000 PSI differential pressure to "stabilize" the shape of convolutions are flat out wrong. Bellows are deformed beyond repair by this practice and they work as long until they fail, and industry experience showed that failures occur randomly at various number of cycles.

SUMMARY OF THE INVENTION

The present invention comprises a gas-charged GLV A shown on FIG. 1 wherein the DEWB-dual edge welded bellows 7 and 10 of the said GLV are protected from both dome and injection high differential pressure. GLV features self-contained DEWB subassembly C shown on FIG. 3 filled with de-gassed and hence non-compressible silicone oil. GLV is normally in vertical orientation in well and upper 7 and lower bellow 10 naming is based on vertical orientation see FIG. 1.

When dome sub 3 is charged with Nitrogen upper bellow 7 is compressed to solid representing mechanical stop, lower bellow 10 is extended for the appropriate distance and telescoping stem 12 which can't be mechanical stop is in closed position against TC orifice 17. Oil contained inside bellow assembly is used as actuator and is pumped from upper bellow 7 to lower bellow 10 making it to expand. Nitrogen 31 is not in direct contact with silicone oil.

When injection pressure 34 is applied it acts against larger area of lower bellow 10 lifting valve closing mechanism-TC ball 16 of the seat 17. Lower bellow 10 effective area is larger than upper bellow 7 effective area for the area of orifice 17 thus compensating for area of the orifice 17 which means that injection pressure 34 equals dome pressure 31 to open the valve. This eliminates differential pressure across the bellows in assembly. This can be optimized for desired port size in this case it is optimized for 0.375" port size. For smaller port sizes valve will open at injection pressure appropriately lower than dome pressure and both bellows 7 and 10 will be exposed to lower differential pressure comparing to system with upper and lower bellows of the same size. For larger port sizes valve will open at injection pressure 34 slightly higher than dome Nitrogen pressure 31 and differential pressure across both bellows 7 and 10 will be minimized. It is possible to equalize bellow sizes for each port size, but it is not necessary because EWB can withstand differential pressure that occurs.

Lower bellow 10 effective area is larger than upper bellow 7 effective area for the area of orifice 17. Force balance equation is as follows:

$$Pb \times Aub - Bsru \times \Delta Lu - Ffu == Pi \times Alb - Bsrl \times \Delta Ll - Ffl + Ao \times Pt$$

When injection pressure 34 is applied and reaches value of dome Nitrogen pressure 31 valve starts to open and injection pressure 34 will act against full larger lower bellow 7 effective area (at this point TC ball 16 contact area is not subtracted from lower bellow area in force balance equation). Once TC ball 16 is slightly lifted of the orifice 17 injection pressure created force will be larger than dome pressure created force because of larger lower bellow 10 area and valve will slowly snap to fully open position. Force balance equation is as flows:

$$Pb \times Aub - Bsru \times \Delta Lu - Ffu == Pi \times Alb - Bsrl \times \Delta Ll - Ffl$$

Where:
Pb=bellow pressure
Aub=upper bellow effective area
Bsru=upper bellow spring rate
ΔLu=upper bellow compression length
Pi=injection pressure
Alb=lower bellow effective area
ΔLl=lower bellow compression length
Ffu=upper bellow friction, can be neglected
Ffl=lower bellow friction, can be neglected
Pt=tubing pressure
Ao=Orifice area
These equations can be solved per desired dome pressure or TROP-injection pressure since other values are design constants.
For particular bellows used for 1.5" nominal size gas lift valve bellow spring force when bellow is completely compressed from free to solid length is approximately 4.5% of pressure exerted force against bellows. Bellow effective area is defined as:

$$Ab=0.5\times(OD+ID)^2\times(\pi/4)==0.5\times(1.022+0.683)=0.668$$
sqin for upper bellow.

Dome force would be: Pd×Ab
For Pd=5000 PSI and Ab=0.668 sqin
Fd=3340 Lb
Injection force is: Fi=Alb×Pi
Upper bellow spring rate is 270 Lb/inch and for ΔLu=0.563 inch this force is 152 Lb to fully compress the bellow to solid. This corresponds to 227 PSI of dome pressure. This is only 4.5% of dome force created by dome pressure and can be neglected in force balance equation for quick calculations of desired parameters. The similar pertains to lower bellow. Silicone oil being transferred from lower 10 to upper bellow 7 will act as a dampener slowing down transition. When valve fully opens lower bellow 10 will be fully compressed to solid. At this point further increase of injection pressure 34 will not be transmitted through silicone oil and pressure transmission to upper bellow 7 stops. Injection pressure 34 at this point can be as high as possible and limited by valve components strength not bellows strength. The same process pertains to upper bellow 7 when dome is charged and injection pressure 34 is absent. This is very usable for well completion integrity testing thus avoiding need for dummy valve application saving one wireline job.

Bellows assembly C shown on FIG. 3 is assembled in fixture G shown on FIG. 7. Silicone oil 29 is filled in excess and both bellows are in relaxed position. Complete fixture G is then rotated in appropriate apparatus and centrifugal force will cause lighter air bubbles contained in silicone oil to move toward to assembly centerline and evacuate upwards due to gravity as shown with arrow 33. Process should last long enough to de-gas oil completely. After oil is de-gassed lower bellow 10 should be compressed to solid height L10, upper bellow 7 would be at free length L7 and upper plug 4 should be installed in place using appropriate tools. This process would provide bellow assembly C proper adjustments. Bellow assembly C shown on FIG. 3 is now ready to be assembled to GLV.
GLV is using high pressure Lee AFO plug 2 shown on FIG. 2 instead of standard tire air valve.

BRIEF DESCRIPTION OF DRAWINGS

The apparatus of the invention is further described and explained in relation to the following figures wherein.

DETAILED DESCRIPTION OF THE DRAWINGS AND OF THE EMBODIMENT OF THE INVENTION

Various aspects and relationships of a preferred embodiment of the current invention will be described in the context of what is commonly known to the gas lift industry as a casing operated 1.5" nominal size wireline retrievable HP GLV. It is within the scope of this patent to apply the present invention to other sizes and configurations of GLV, chemical injection valves both as wireline retrievable and tubing retrievable GLV and both IPO-injection pressure operated or PPO-production pressure operated GLV.

Figure 1:
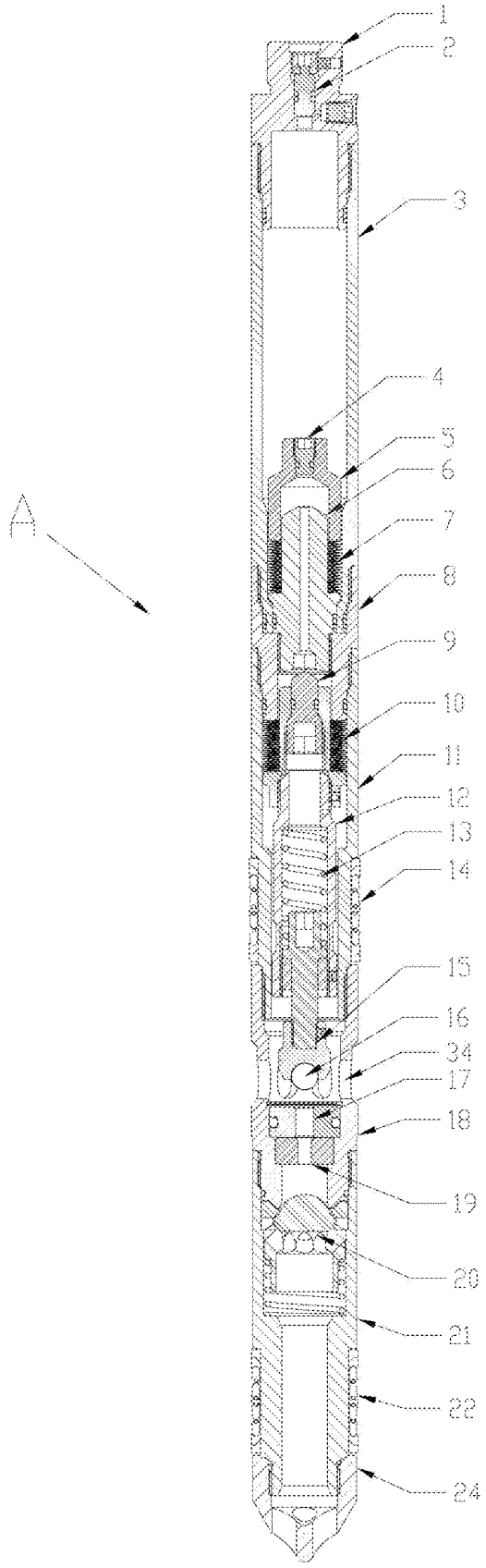
FIG. 1 is showing cross sectional view of a typical HP-high pressure wireline retrievable gas lift valve A of the preferred embodiment.
Figure 2:
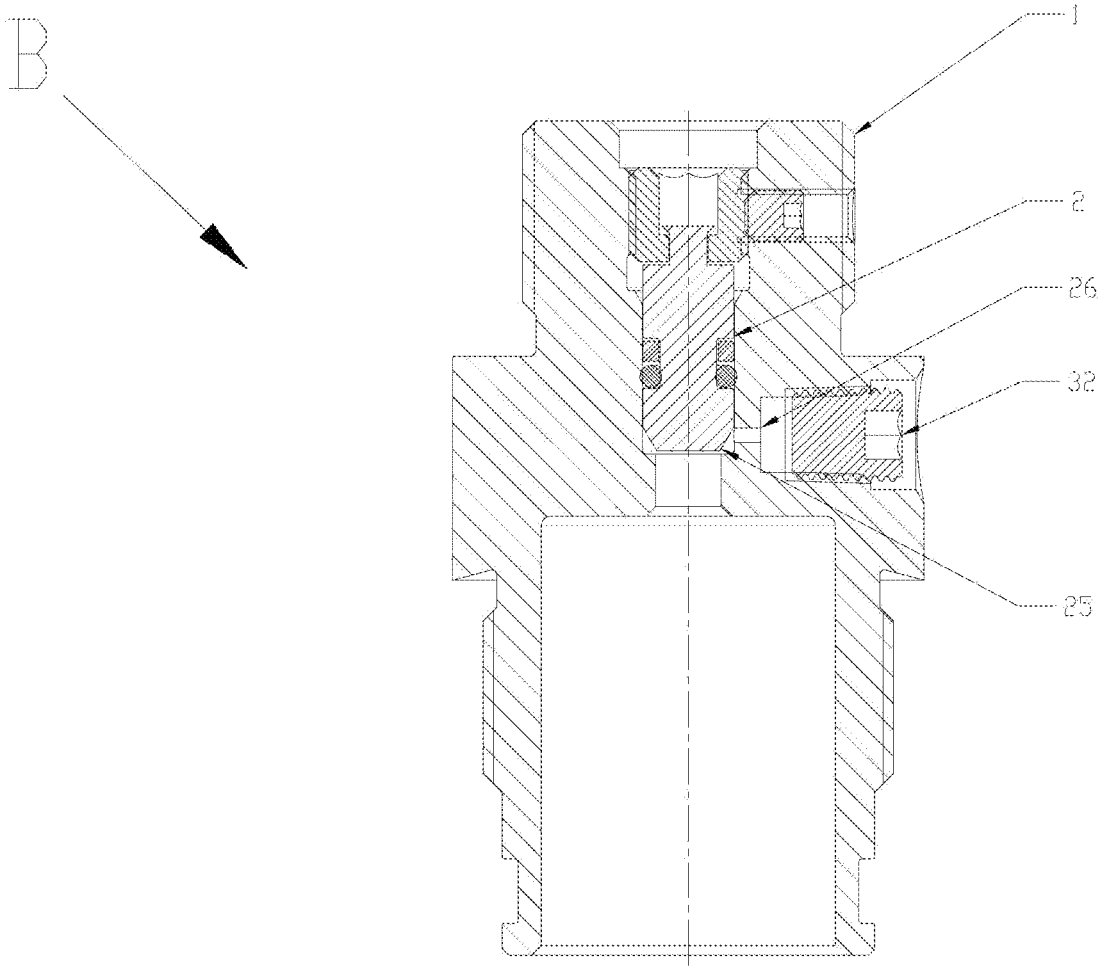
FIG. 2 shows cross sectional view of the high-pressure Lee AFO plug subassembly that is used instead of typical automotive low-quality valve to charge Nitrogen into dome volume with redundant NPT plug.
Figure 3:
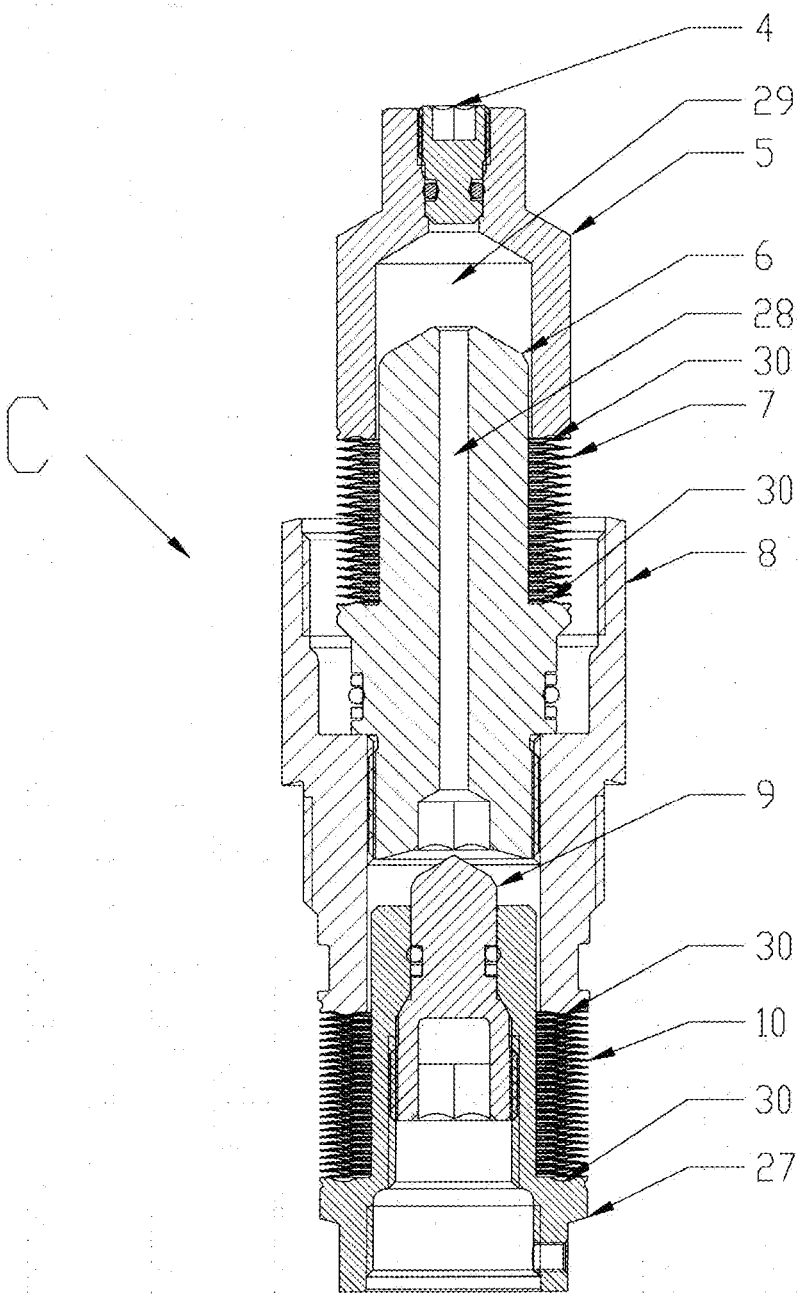
FIG. 3 shows cross section view of the bellow subassembly C of the preferred embodiment illustrated with both bellows in neutral position.

FIG. 1 illustrates valve A into which the present invention has been adapted. The valve A in FIG. 1 consist of Nitrogen charging assembly B shown on FIG. 2 which includes Lee HP AFO plug 2 with sealing O-ring, redundant NPT plug 3 threaded into housing 1. Dome chamber 3 is assembled against housing 1. Bellow subassembly shown on FIG. 3 is assembled against dome chamber 3, telescoping stem 12 assembled into telescoping stem housing 11 and assembled against bellow subassembly shown on FIG. 3. Valve lower portion containing inlet sub 18, orifice 17, check dart 20, check dart housing 21 and nose 24 is assembled against telescoping stem housing 11.

Valve features set of external upper seals 14 and lower seals 22 employed to pack off the valve into upper and lower seal bore of an appropriate GLM common to the industry and not illustrated herein. The appropriate latch mechanism not shown for clarity is assembled against upper housing 1 to lock valve in gas lift mandrel.

The HP EWB subassembly shown on FIG. 3 consists of upper bellow 7 that is welded against upper body 6 and upper sliding sub 5, lower bellow 10 that is welded against mid sub 8 and lower sub 27. Cavity of bellow subassembly is filled with silicone oil 29 and sealed by upper plug 4 and lower plug 9 which both feature O-rings for sealing the silicone oil. Upper sliding sub 5, upper body 6, mid sub 8 and lower sub 27 have geometry of bellow mating surfaces 30 of the same shape as bellows convex and concave surfaces.

Figure 4:
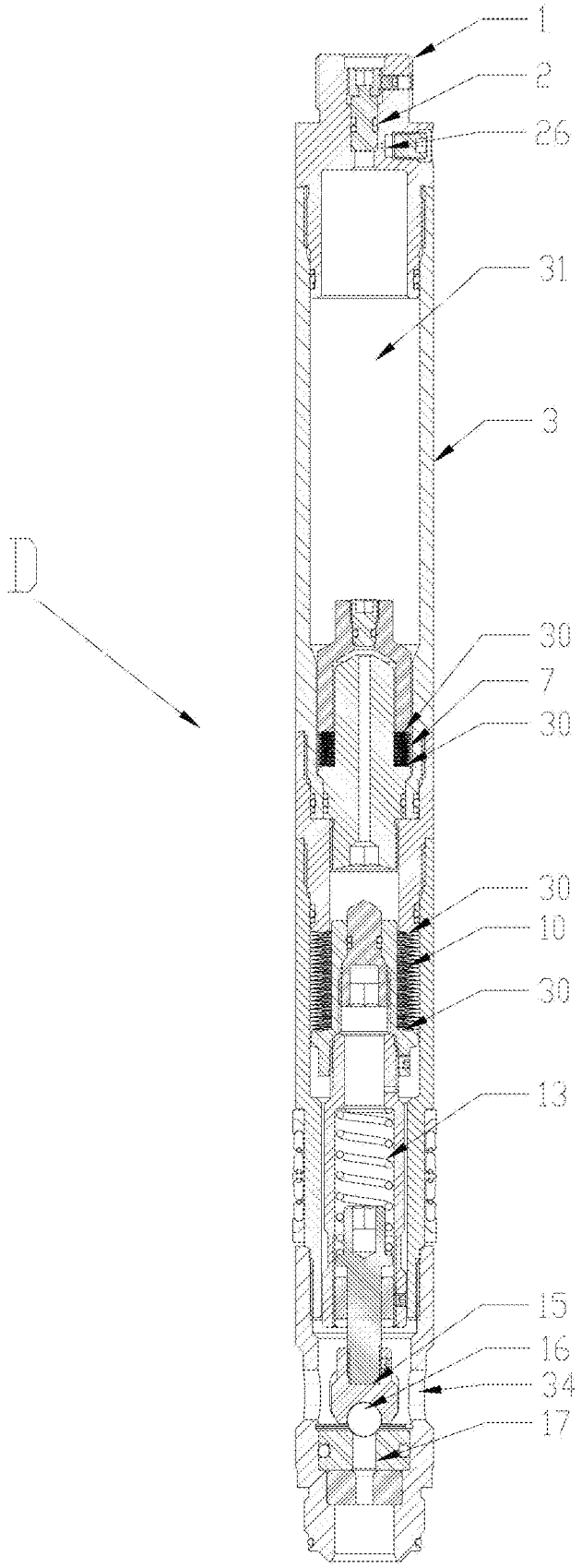
FIG. 4 shows GLV cross section D without lower portion of the valve removed for clarity with upper bellow in fully compressed position to solid with dome Nitrogen pressure applied, lower bellow in fully expanded position, telescoping stem in closed position and silicone oil transferred from upper to lower bellow.

FIG. 4 shows GLV A of present invention in closed position. Lower portion of the valve with check dart 20 is not shown for clarity. When Nitrogen 31 pressure is applied through port 26 to dome sub 3 upper bellow 7 will be fully compressed to solid and bellow elements will be touching each other and boot against mating surfaces 30. Silicone oil 29 will be transferred from upper bellow 7 to lower bellow 10 that will expand, pushing telescoping stem 12 to closed position. TC ball 16 will close against orifice 17 while spring 13 would compensate movement of the telescoping stem 12 since solid upper bellow 7 will be mechanical stop because two mechanical stops at the same time are not possible. At this point injection pressure 32 is not present because valve is not installed to well and this pressure is atmospheric.

Figure 5:
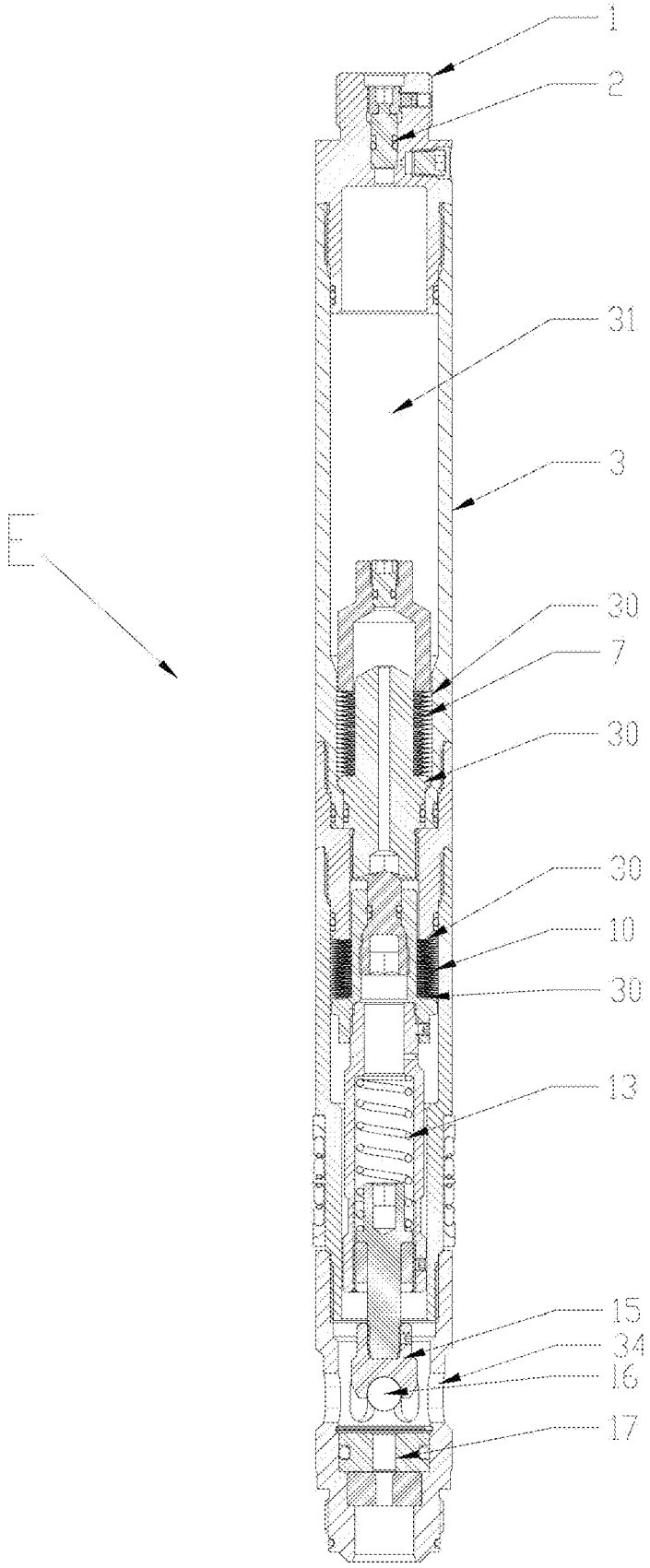
FIG. 5 shows GLV cross section E without lower portion of the valve removed for clarity with upper bellow in fully expanded position with dome Nitrogen pressure applied, lower bellow in fully compressed position by applied injection pressure, telescoping stem in fully open position and silicone oil transferred from lower to upper bellow.

FIG. 5 shows valve A of present embodiment in fully open position with injection pressure 32 applied, lower bellow 10 fully compressed to solid, upper bellow 7 fully expanded by silicone oil 29 transferred from lower bellow 10 to upper bellow 7. It should be noted that velocity of silicone oil 29 transfer between bellows is smooth and controlled by hole 28 size. Injection pressure 32 at this point is high enough to overcome Nitrogen dome pressure 31 and valve load rate. Lower telescoping stem 15 and TC ball 16 is lifted of the orifice 17, spring 13 is fully expanded and telescoping stem 12 is retracted following lower bellow 10 movement. GLV starts injecting gas into formation as soon as TC ball 16 is lifted of the orifice 17. As injection pressure is decreasing GLV will start closing process in sequences opposite to valve opening.

Figure 6:
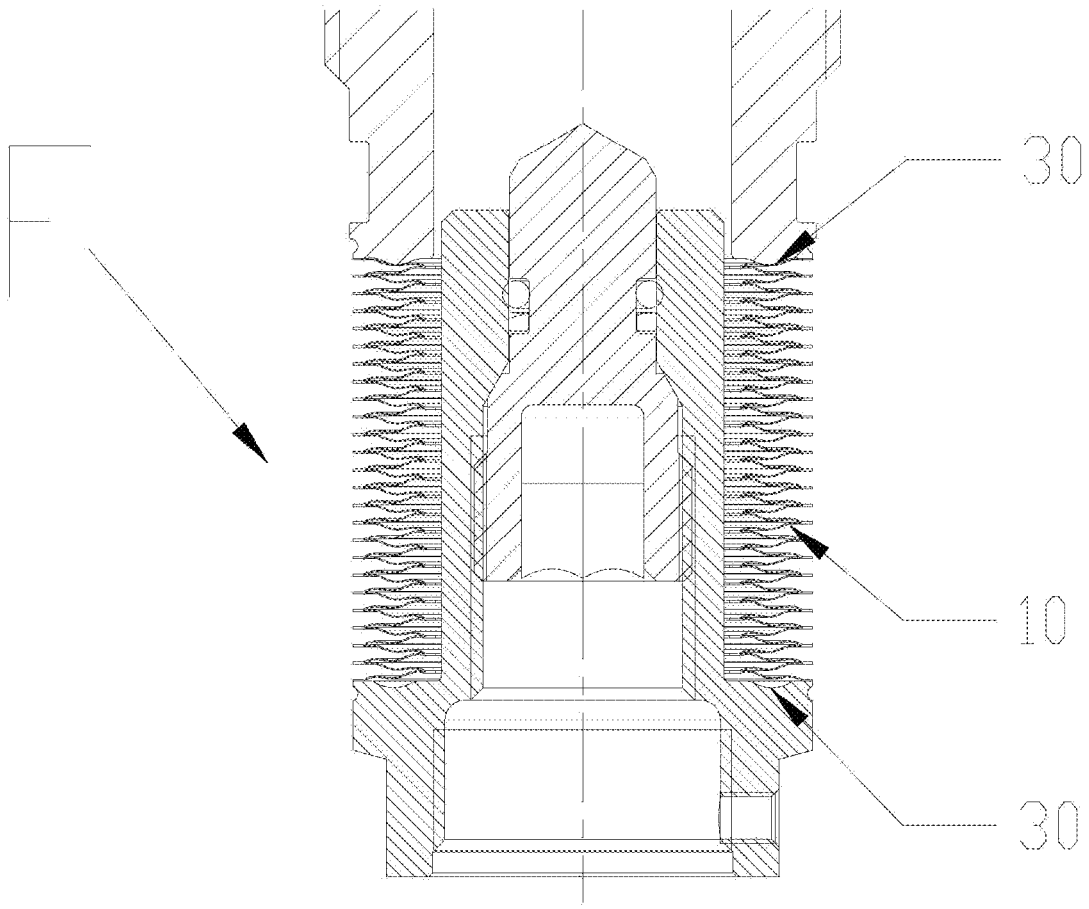
FIG. 6 shows lower bellow partial cross section F showing bellow concave and convex curvatures and mating surface curvatures that are both of equal geometry which provides perfect bellow alignment against mating surface to which bellow is welded once bellow is fully compressed to solid.
Figure 7:
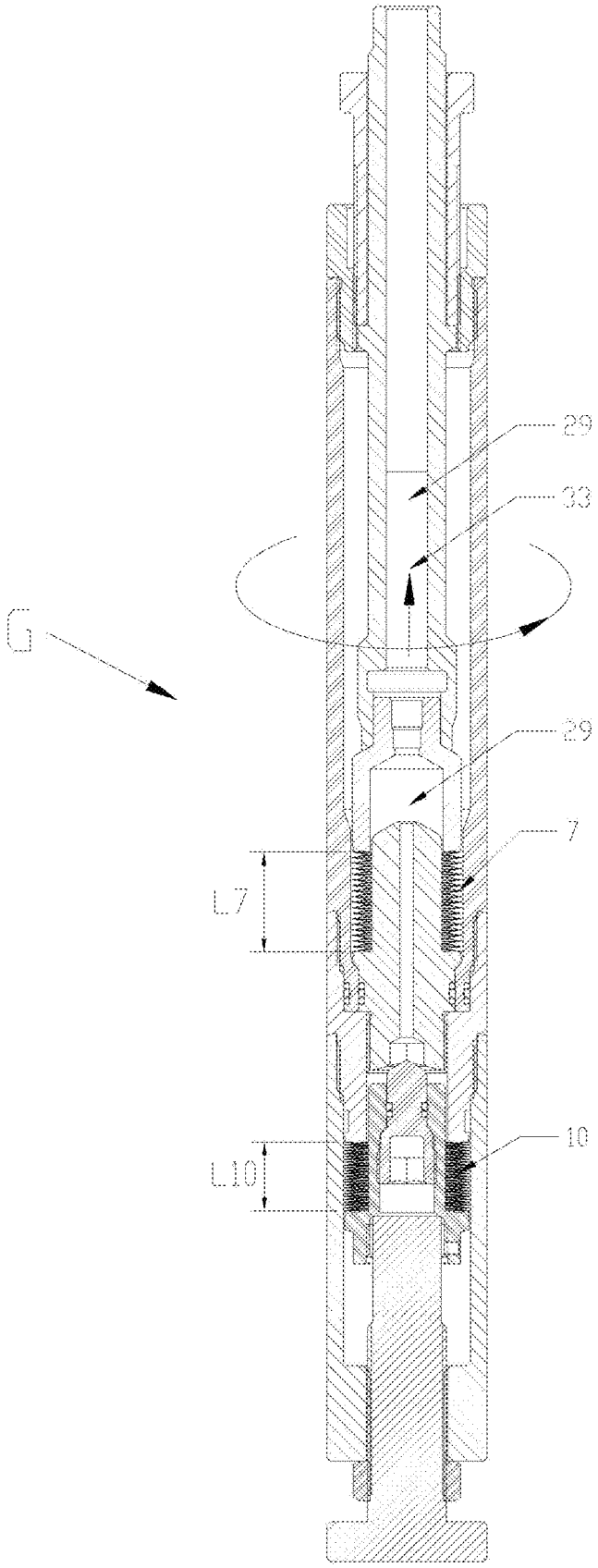
FIG. 7 shows GLV assembling fixture G that is used to constrain bellows to desired position for assembling and to de-gas silicone oil by rotating complete fixture.

FIG. 6 shows enlarged bellow 10 cross sectional detail where it is obvious that geometry 30 against which bellow is welded is of the exact same geometry as bellow elements. This would provide perfect contact between bellow element and mating part once bellow is fully compressed. The same pertains to both bellows 7, 10 and mating parts 5, 6, 8, and 27 to which bellows are welded. This feature reduces the stress of the bellows that will be exposed only to compression stress once in full compression to solid.

The above description of certain embodiment is made for the purposes of illustration only and are not intended to be limiting in any manner. Other alterations and modification of the preferred embodiment will become apparent to those of ordinary skill in the art upon reading this disclosure, and it is intended that the scope of the invention disclosed herein be limited only by the broadest interpretation of the appendix claims to which the invention is legally entitled.

What is claimed is:

1. A gas lift valve (GLV) capable of withstanding high differential pressure comprising:

an edge welded bellows (EWB) containing a plurality of convolutions, wherein the bellows can contract and expand;

a dome sub connected to bellows subassembly containing pressurized gas-nitrogen charge, telescoping stem housing connected to a lower bellow containing telescoping spring-loaded stem and a TC ball closing mechanism;

an EWB subassembly consisting of an upper bellow and said lower bellow welded to mating parts containing sealed degassed silicone oil volume transfer between upper and lower bellow depending on dome and injection pressure; wherein a mechanism involving telescoping stem is spring loaded with the TC ball mechanism to open and close the injection gas passage through valve, wherein the upper and lower bellow is configured to fully compress to solid by design, wherein the mating parts to which the bellows are welded comprises a same convex and concave geometry as the upper and lower bellows, wherein fitting such that said gas lift valve is capable of withstanding compression pressures up to 30 KSI;

a one-way check valve located at a GLV lower end prevents flow opposite to normal flow, and a fluid selected from the group consisting of an injection gas and a well fluid wherein the injection fluid is located in exterior of the lower bellow and provides an external pressure to the lower bellow, and wherein the bellows are selected to have the approximately same volumetric oil displacement for selected bellow travel, compression/expansion thereby the oil transferred from upper to lower bellow has approximately equal volume, wherein the GLV bellow assembly is filled with silicone oil degassed by centrifugal process where assembling fixture with said bellow assembly is rotated-centrifuged until gas is removed from oil, fully non-compressible fluid, a silicone oil used to fill the bellow subassembly and de-gassed using centrifugal force, and wherein the EWB of the GLV is fully compressed to solid at certain pressure, silicone oil is transferred to opposite bellow, any further pressure increase against compressed bellow will not be transmitted to expanded bellow and expanded bellow will be fully pressure balanced and thereby protected from over-pressurizing, thereby useful for well integrity (pressure) testing, by eliminating need for using dummy valve and saving at least one wireline job.

2. The GLV of claim 1, wherein the valve starts to open when injection pressure reaches proximity of nitrogen dome pressure and closes as injection pressure decreases below dome nitrogen pressure, wherein the nitrogen dome pressure is adjusted during a valve TROP (text rack opening pressure) setting process by axial force only (AFO) plug configuration with a redundant NPT plug without removing the valve from test donut.

3. The GLV of claim 1, wherein the valve is tubing retrievable wireline retrievable type.

4. The GLV of claim 1, further comprising of upper and lower EWB, wherein the lower bellow features a larger OD and a larger effective bellow area (EBA) than upper bellow OD and EBA, wherein a difference in lower versus upper EBA is equal to orifice area which means that valve test rack opening pressure (TROP) is very close to nitrogen dome pressure resulting in near zero differential pressure across both bellows equalizing stress of the bellows, pertains only for one orifice size.

5. The GLV of claim 1, further includes:

(a) lower bellow is assembled during last step that is completely compressed to solid to length L10 while upper bellow is expanded to free length L7 and excess oil is pushed out of bellow assembly into cavity of the assembling fixture, and the upper plug securely seal the oil chamber;

(b) the bellow assembly is removed from assembling fixture bellows that will relax and set into neutral position; wherein, due to different spring rates of upper and lower bellow neutral position will be off the middle, and (c) valve installed in both bellows work only in compression from free length to solid state, thereby beneficial for extended bellow life and lower overall stress level.

6. The GLV of claim 1, wherein the GLV is configured to snap to fully open position as soon as TC ball is lifted of the seat-orifice and injection pressure is held constant or slightly higher than dome pressure, thereby providing larger lower bellow resulting in larger effective bellow area comparing to upper bellow area and the area difference corresponds to orifice surface area, wherein: (a) Once valve opens force exerted by injection pressure against lower bellow is larger than upper bellow force exerted by nitrogen and this force differential results in snap opening of the valve, and (b) velocity of valve opening and closing is further controlled by adjusting the size of connecting hole between two bellows.

7. The GLV of claim 1, wherein the GLV requires lower differential pressure between dome nitrogen and injection pressure to fully opens, wherein: (a) when injection pressure is introduced and reaches proximity of dome pressure valve starts to open, (b) when valve slightly opens injection force (Ft) exerted on lower larger bellow is larger than dome force ($F_d$) created by nitrogen pressure acting upon smaller upper bellow because at this point orifice area is not a factor in force balance equation and valve would snap to open position, and (c) injection pressure required to keep valve in fully open position is lower comparing to valves with same size of upper and lower bellow.

8. The GLV of claim 1, wherein the GLV is configured to significantly reduces possibility of chatter, wherein the valve snaps to fully open position much easier comparing to valves which have lower and upper bellow of the same sizes and the chatter is further decreased by optimizing diameter of connecting hole between two bellows.

9. The GLV of claim 1, wherein the GLV comprises dome nitrogen pressure that is not limited by bellow strength, wherein the GLV component strength since bellow fully compressed to solid can withstand high pressure that is higher than components pressure.

* * * * *